US006691394B1

(12) United States Patent
McClean

(10) Patent No.: US 6,691,394 B1
(45) **Date of Patent: *Feb. 17, 2004**

(54) DISK-TOP FLUID DISPENSING PACKAGE

(75) Inventor: Craig E. McClean, McGaheysville, VA (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/277,381

(22) Filed: Oct. 22, 2002

Related U.S. Application Data

(62) Division of application No. 09/781,799, filed on Feb. 12, 2001.

(51) Int. Cl.[7] ..... B23P 11/00

(52) U.S. Cl. ..... 29/434; 222/534; 222/536; 222/556

(58) Field of Search ..... 29/434; 222/533, 222/534, 536, 556

(56) References Cited

U.S. PATENT DOCUMENTS

| | | | | |
|---|---|---|---|---|
| 2,361,958 | A | | 11/1944 | Nyden |
| 3,467,287 | A | * | 9/1969 | Marchant et al. ..... 222/480 |
| 3,542,256 | A | | 11/1970 | Waterman |
| D236,880 | S | | 9/1975 | Sway |
| D245,225 | S | | 8/1977 | Lyons |
| 4,962,869 | A | | 10/1990 | Gross et al. |
| 5,114,659 | A | | 5/1992 | Krall |
| 5,192,005 | A | | 3/1993 | Zimmerman |
| 5,213,235 | A | | 5/1993 | Miranda |
| 5,236,107 | A | | 8/1993 | Spaanstra, Sr. |
| 5,279,451 | A | | 1/1994 | Mueller et al. |
| 5,284,264 | A | | 2/1994 | Gross |
| 5,314,093 | A | | 5/1994 | Gross et al. |
| 5,341,960 | A | | 8/1994 | Lay |
| 5,346,100 | A | | 9/1994 | Lay |
| 5,370,284 | A | | 12/1994 | Dirksing |
| 5,622,284 | A | | 4/1997 | Sawicki |
| D383,390 | S | | 9/1997 | Abfier et al. |
| 5,662,245 | A | * | 9/1997 | Grant ..... 222/153.07 |
| 5,695,097 | A | | 12/1997 | Röllinghoff |
| 5,709,318 | A | | 1/1998 | Oder |
| 5,862,963 | A | | 1/1999 | Fuchs et al. |
| 5,868,283 | A | | 2/1999 | Wilson et al. |
| 5,873,494 | A | | 2/1999 | Dallas, Jr. |
| 5,962,096 | A | | 10/1999 | Smith et al. |
| 6,029,866 | A | | 2/2000 | Wood et al. |
| D423,361 | S | | 4/2000 | Negre |
| D425,427 | S | | 5/2000 | Heeter |
| D426,158 | S | | 6/2000 | Flurer et al. |
| D427,072 | S | | 6/2000 | Gaffney |
| D427,073 | S | | 6/2000 | Gaffney et al. |
| 6,283,333 | B1 | | 9/2001 | Knickerbocker et al. |
| 6,394,323 | B2 | | 5/2002 | McClean et al. |
| 6,564,978 | B1 | * | 5/2003 | Safian et al. ..... 222/534 |

OTHER PUBLICATIONS

Application of John W. Safian and Richard R. Johnston Ser. No. 09/781,644 filed Feb. 12, 2001 and entitled Disk–Top Fluid Dispensing Package.

* cited by examiner

*Primary Examiner*—David P. Bryant

(57) ABSTRACT

A dispensing package for fluent products includes a container of one-piece integrally molded plastic construction having a hollow flexible body, and a rigid integral finish defined by a deck that spans one end of the body, a package dispensing opening in the deck and a wall upstanding from a perimeter of the deck surrounding the deck and the opening. An actuator disk is mounted within the peripheral wall overlying the deck and the dispensing opening, and is pivotal between a closed position closing the opening and an open position for dispensing product from the opening through the actuator disk.

3 Claims, 5 Drawing Sheets

DISK-TOP FLUID DISPENSING PACKAGE

This application is a division of application Ser. No. 09/781,799 filed Feb. 12, 2001.

The present invention is directed to packages for dispensing fluid products such as body lotions, and more particularly to a package and method of construction that feature an actuator disk that pivots between a closed position and an open position for dispensing fluid product from the package.

Reference is made to the copending application of John W. Safian and Richard R. Johnston Ser. No. 09/781,644 filed Feb. 12, 2001 and entitled Disk-Top Fluid Dispensing Package.

BACKGROUND AND SUMMARY OF THE INVENTION

Disk-top fluid dispensing packages conventionally include a container with a finish, and a dispensing closure assembly having a base secured to the container finish and an actuator disk pivotally mounted on the closure base. The disk is pivotal between a closed position that closes a dispensing opening in the closure base, and an open position for dispensing fluid product from the package. A package of this type is illustrated, for example, in U.S. Pat. No. 5,862,963. A general object of the present invention is to provide a package of this type in which the closure is integrated into the dispensing package. Others objects of the present invention are to provide a method of making such an integrated package, and a container for use in such an integrated package.

A dispensing package for fluent products in accordance with presently preferred embodiments of the invention includes a container of one-piece integrally molded plastic construction having a hollow flexible body, and an integral finish defined by a deck that spans one end of the body, a package dispensing opening in the deck and a wall upstanding from a perimeter of the deck surrounding the deck and the opening. An actuator disk is mounted within the peripheral wall overlying the deck and the dispensing opening, and is pivotal between a closed position closing the opening and an open position for dispensing product from the opening through the actuator disk. Provision of a two-piece package that includes a one-piece integrally molded container with finish deck, peripheral wall and dispensing opening reduces manufacturing, tooling and inventory costs, and reduces the weight of the overall package. The dispensing opening may be enlarged for easier and more rapid filling of the container, while the dispensing rate may be tailored by varying the size of the dispensing opening in the actuator disk. In the preferred embodiments of the invention, the actuator disk has laterally extending aligned trunnions or pins that are received through laterally aligned openings in the peripheral wall of the container finish. This gives greater strength to the actuator/finish connection, and the actuator is less likely to become disassembled from the finish during use. Alternatively, part-spherical pivots may be employed.

In accordance with another aspect of the present invention, a method of making a fluid dispensing package contemplates integrally molding a one-piece plastic container having a hollow flexible body, and a rigid finish including a deck extending across one end of the body, a dispensing opening in the deck, a peripheral wall extending around the deck and disk mounting means in the wall. An actuator disk is mounted within the wall by the disk mounting means to pivot within the wall between a closed position closing the dispensing opening, and an open position for dispensing product from the container through the opening and the disk. The container preferably is filled with product through the dispensing opening prior to assembly of the actuator disk to the container finish. A container for a disk-top fluid dispensing package in accordance with a third aspect of the present invention is of one-piece integrally molded plastic construction having a hollow flexible body, and a rigid finish including a deck extending across one end of the body, a peripheral wall extending around the deck, a dispensing opening in the deck, and disk mounting means on opposed sides of the wall. The dispensing opening in the preferred embodiment of the invention is keyhole-shaped, having an enlarged portion centered on the deck and a smaller portion radially offset from the enlarged central portion. The larger diameter portion of the keyhole-shaped opening in the preferred embodiment aids in filling the container. Alternatively, the fell/dispensing opening may be circular or oval. The hollow body of the container may be in the form of a tottle, a cylindrical container with a flat bottom, or a squeezable tube.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
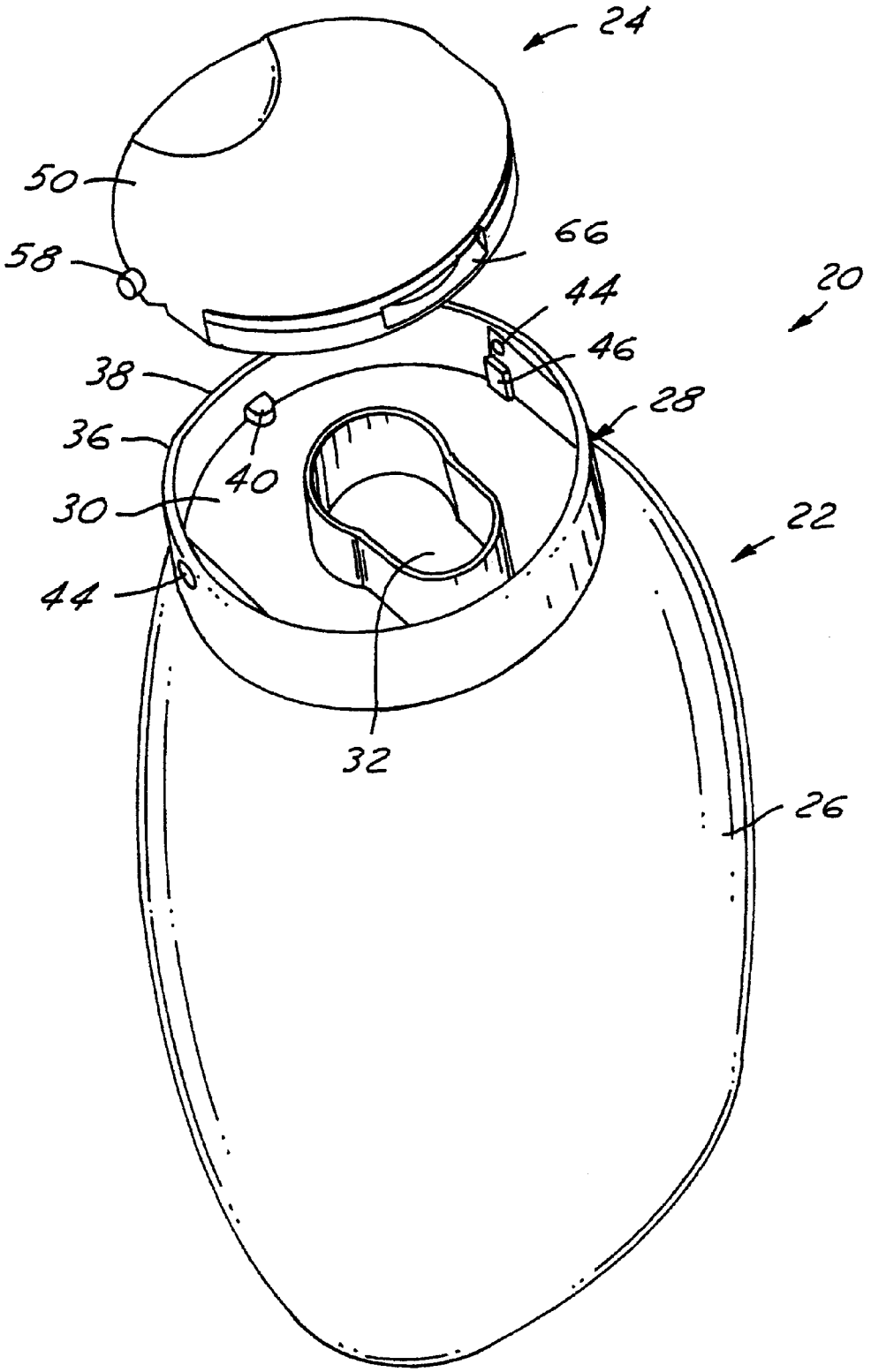
FIG. 1 is an exploded perspective view of a fluid product dispensing package in accordance with one presently preferred embodiment of the invention.
Figure 2:
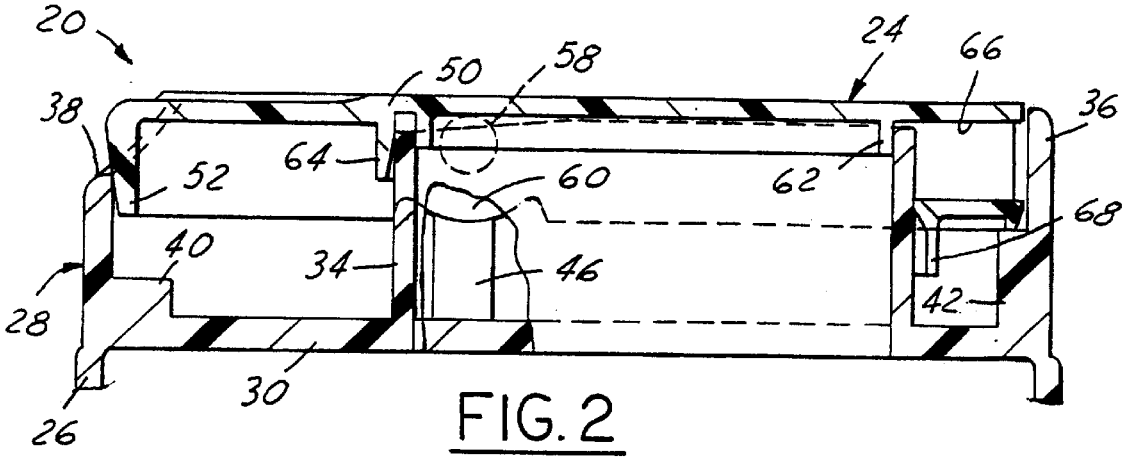
FIG. 2 is a fragmentary sectional view that bisects the container finish and actuator disk in the package of FIG. 1.
Figure 3:
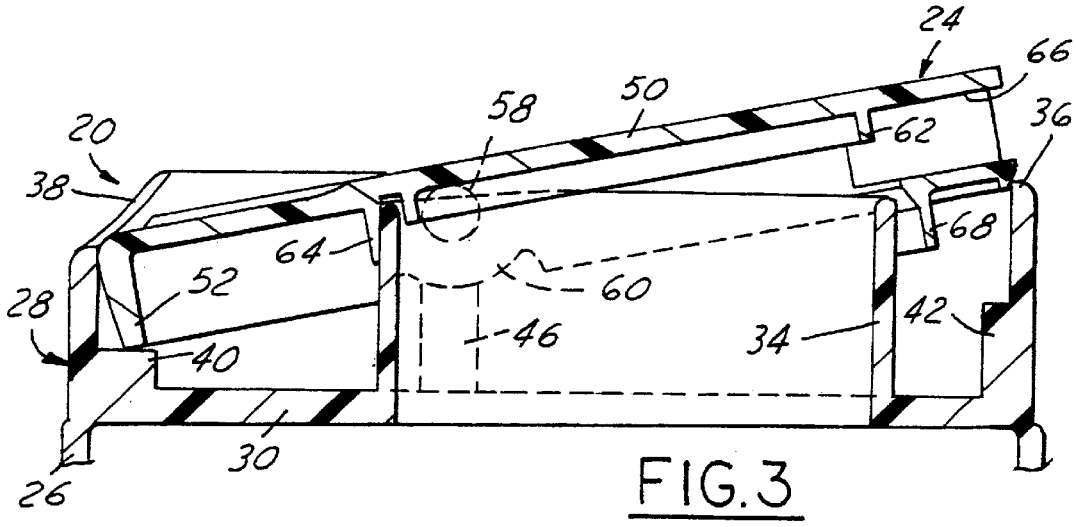
FIG. 3 is a view similar to that of FIG. 2 but showing the actuator disk in the open position.

FIGS. 1–3 illustrates a fluid dispensing package 20 in accordance with one presently preferred embodiment of the invention as comprising a container 22 and a disk-type dispensing actuator 24. Container 22 is of one-piece integrally molded plastic construction, having a hollow flexible body 26 and an integral rigid finish 28. Referring to FIGS. 1–6, container finish 28 includes a flat relatively rigid deck 30 that extends laterally across one end of container body 26 in a plane perpendicular to the longitudinal axis of the container body. A keyhole-shaped fill/dispensing opening 32 is formed in deck 30, having an enlarged central portion 32*a* (FIG. 4) coaxial with container body 26 and centrally disposed in deck 30, and a smaller portion 32*b* extending radially from central portion 32*a*. Fill/dispensing opening 32 is surrounded by a wall 34 that is integral with deck 30 and extends axially upwardly from the deck (in the orientation of FIGS. 1–3).

A peripheral wall 36 extends upwardly from deck 30 around the perimeter of the deck. Peripheral wall 36 has a recessed portion 38 laterally aligned with the long dimension of keyhole-shaped opening 32 on a side thereof remote from smaller keyhole portion 32*b*. An abutment rib 40 extends upwardly from deck 30 along wall 36 beneath recessed portion 38 to serve as an abutment stop for the actuator disk in the fully open position of the latter (FIG. 3). A second abutment rib 42 extends from deck 30 along wall 36 adjacent to the ensmalled portion 32*b* of dispensing opening 32 to act as an abutment stop for the disk actuator in the fully closed position of the latter (FIG. 2). A pair of circular openings 44 (FIGS. 1 and 6) are laterally aligned with each other across wall 36 at a position offset from enlarged portion 32*a* of dispensing opening 32. A pair of bearing ribs 46 extend upwardly from deck 30 beneath respective openings 44, and terminate in concave arcuate bearing surfaces 48 for supporting the disk actuator during opening and closing of the latter, as will be described.

Figure 4:
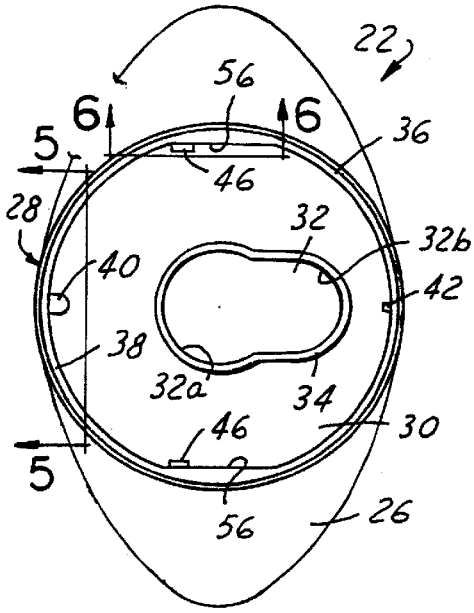
FIG. 4 is a top plan view of the container illustrated in FIG. 1.
Figure 5:
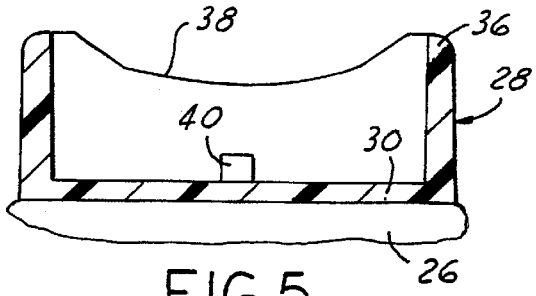
FIGS. 5 and 6 are fragmentary sectional views taken substantially along the respective lines 5—5 and 6—6 in FIG. 4.
Figure 6:
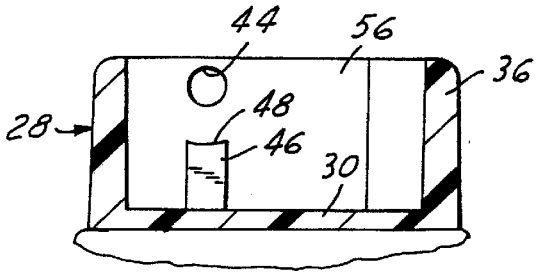
Figure 7:
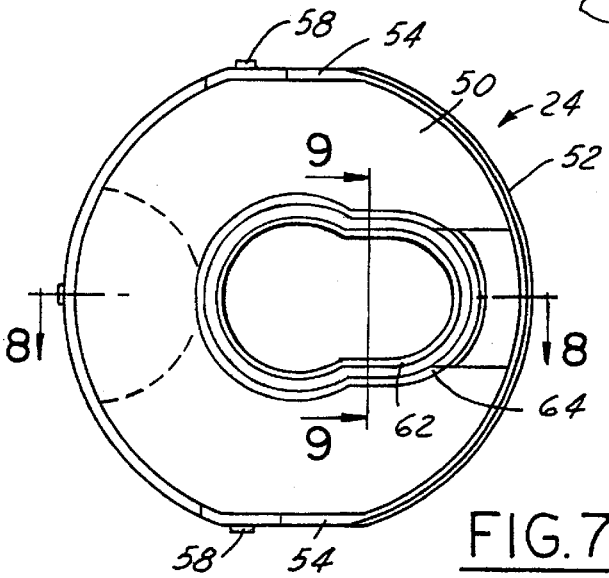
FIG. 7 is a bottom plan view of the actuator disk in the package of FIG. 1.
Figure 9:
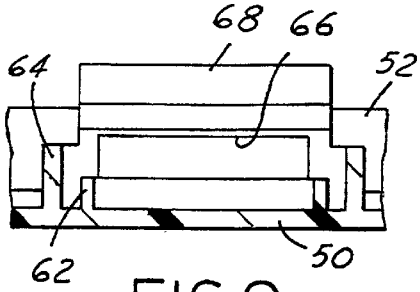
FIGS. 8 and 9 are fragmentary sectional views taken substantially along the respective lines 8—8 and 9—9 in FIG. 7.
Figure 8:
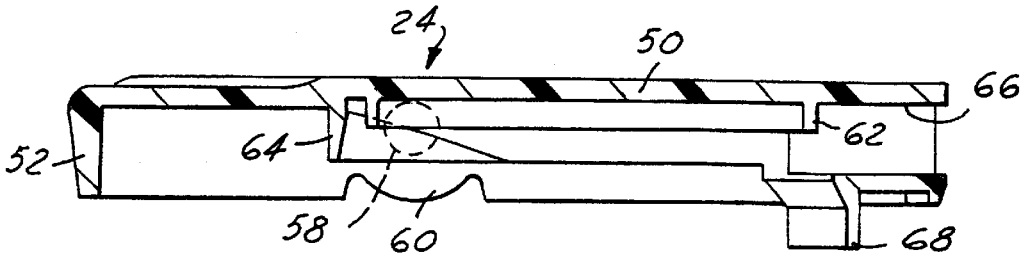

Actuator disk 24 is a one-piece generally flat body having a base wall 50 from which a peripheral wall 52 depends. Disk 24 is generally circular, having diametrically opposed flat portions 54 for disposition within opposed flats 56 on container wall 36 (FIG. 4). Alternatively, the disk may be non-circular if desired. A pair of cylindrical trunnions or posts 58 are laterally aligned with each other and extend outwardly from flat portions 54 of disk wall 52 for receipt by snap fit within openings 44 on container wall 36. Beneath posts 58, disk wall 52 has a pair of convex circular bearing portions 60 that ride on bearing surfaces 48 of ribs 46 to support disk 24 during pivoting of the disk around the axis of pins 58 and openings 44. Within the periphery of disk base wall 50, there are inner and outer keyhole-shaped walls 62, 64 that are disposed, in assembly with container body 26, inside of and outside of wall 34 on container finish 28, as best seen in FIGS. 2 and 3. Inner wall 62 is continuous and forms a plug seal within fill/dispensing opening wall 34 in the closed position of actuator disk 24 (FIG. 2). Outer wall 64 is interrupted by a lateral passage 66 that extends to the periphery of actuator disk 24 forming a fluid dispensing outlet passage from the actuator disk. A shield 68 depends from passage 66 and cooperates with wall 34 on container finish 28 to route fluid through actuator dispensing passage 66 in the open position of the actuator disk (FIG. 3).

Container 22, including container body 26 and integral finish 28, may be formed in an injection/extrusion/blow molding operation, in which finish 28 is first injection molded, a tubular preform is then extruded from the injection molded finish, blow mold sections are closed around the tubular preform, and container body 26 is then blow molded to the internal confines of the blow mold sections. Container body 26 is relatively flexible to permit squeezing of the container body in order to dispense product from the actuator passage when the actuator is in the open position. The finish is relatively rigid to maintain its geometry during transport and use. Container 22 may be of high density polyethylene construction, for example. Actuator disk 24 is preferably injection molded of suitable material, such as polypropylene. Container finish 28 and actuator disk 24 are circular in the embodiment of FIGS. 1–9. However, other geometries, such as oval or elliptical geometry, are also contemplated. Likewise, although the pivot axis of disk 24 is parallel to the long lateral dimension of the non-circular geometry of container body 26 in the illustrated embodiment, the pivot axis could be perpendicular to such dimension. The finish and actuator disk could also be used with containers having a body that is cylindrical or other suitable shape.

Figure 10:
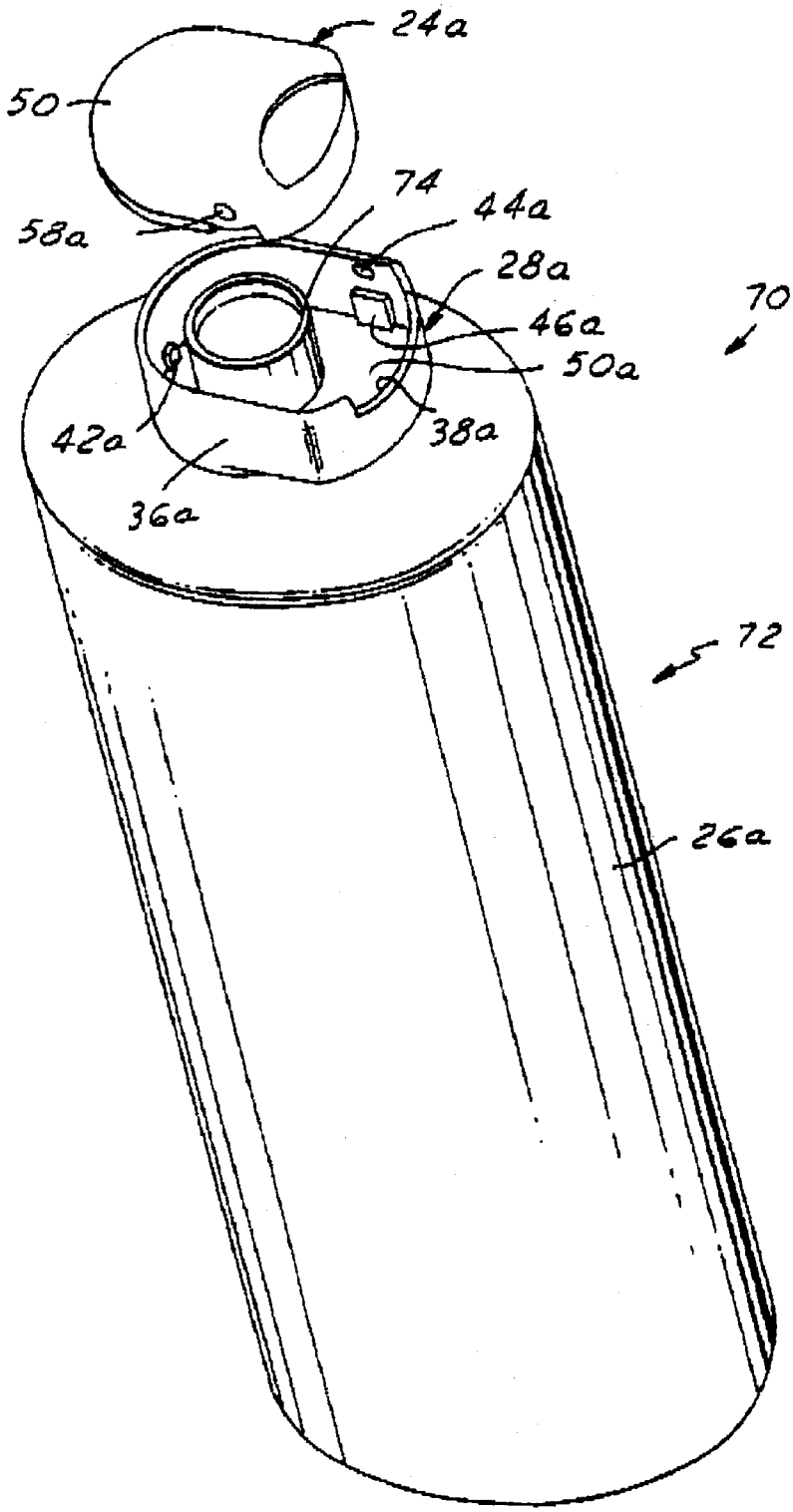
FIG. 10 is an exploded perspective view of a fluid dispensing package in accordance with a modified embodiment of the invention.
Figure 11:
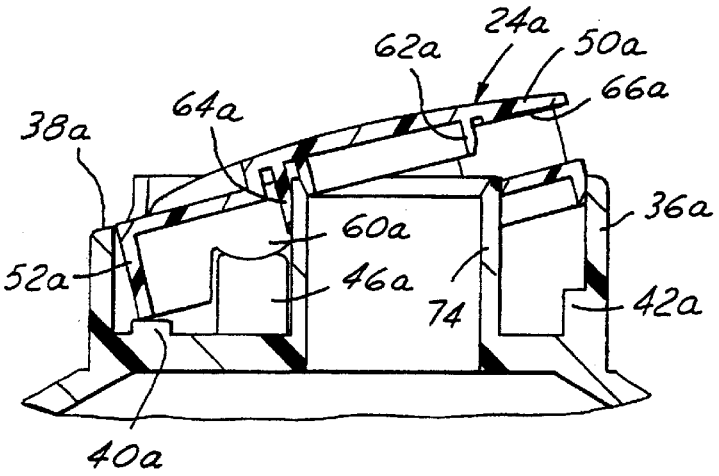
FIG. 11 is a fragmentary sectional view of the finish and actuator disk in the package of FIG. 10.
Figure 12:
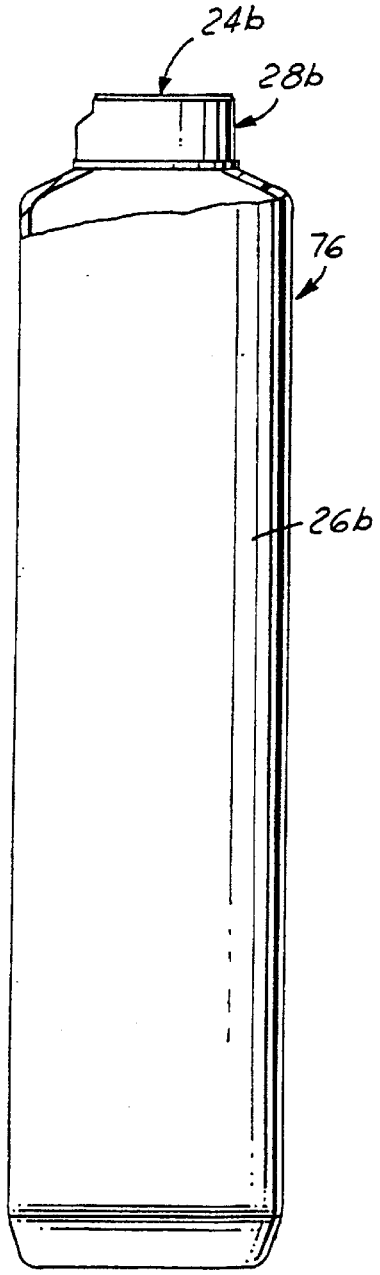
FIG. 12 is a partially sectioned elevational view of a fluid dispensing package in accordance with a third embodiment of the invention.

In the embodiment of FIGS. 1–9, container 22 is a so-called tottle-type container, and the package is adapted to be rested on its head on a flat surface. However, the principles of the present invention may also be applied to containers having a flat bottom as illustrated in FIGS. 10–11, and to flexible tube-type containers as illustrated in FIG. 12. Referring to FIGS. 10–11, a package 70 includes a container 72 having a hollow flexible body 26*a* and a relatively rigid finish 28*a*. Finish 28*a* is molded integrally with body 26*a* in an injection/extrusion/blow molding operation as previously described. Finish 28*a* includes an annular wall 74 that surrounds a circular fill/dispensing opening of container 72. The remaining elements of package 70 in FIGS. 10 and 11 are similar to those described above in connection with the embodiment of FIGS. 1–9, and are indicated by correspondingly identical reference numerals followed by the suffix "a". The primary difference between package 70 of FIG. 10 and package 20 of FIG. 1 lies in the fact that container body 26*a* has a flat bottom for placement on a support surface. FIG. 12 illustrates a package 76, in which container body 26*b* has a squeezable tube-type body 26*b*. A finish 28*b* is integrally molded with body 26*b* as previously described, and a disk-type actuator 24*b* is pivotally secured within finish 28*b*.

Thus, in all embodiments, the container body is of flexible blow molded plastic construction, and the container finish is molded integrally with the body. The dispensing actuator disk is secured to the container finish either before or after filling of the container, depending upon the type of container. In traditional bottles or tottles having a fill opening in the finish (e.g., FIGS. 1 and 10), the disk is secured to the container finish after filling. For flexible tube-type containers (e.g., FIG. 12 or U.S. Pat. No. 5,962,096), the disk may be secured to the container finish before the bottom of the tube is removed and the container filled through the bottom and then sealed.

There have thus been disclosed a package, a method of manufacture and a container that fully satisfy all of the objects and aims previously set forth. As compared with dispensing packages having conventional closure assemblies, the container and package of the present invention exhibit reduced manufacturing, tooling and inventory costs, and reduced weight. The enlarged keyhole-shaped fill/dispensing opening in the embodiment of FIG. 1 may be rapidly filled with product to reduce manufacturing time, and dosage rate can be readily varied by varying the size of the dispensing passage 66 in the actuator disk. A number of embodiments of the present invention have been disclosed, together with various modifications and variations. Other modifications and variations will readily suggest themselves to persons of ordinary skill in the art. The invention is intended to embrace all such modifications and variations as fall within the spirit and broad scope of the appended claims.

What is claimed is:

1. A method of making a fluid dispensing package, which comprises the steps of:

(a) integrally molding a one-piece plastic container having a hollow body, and a rigid finish including a deck extending across one end of said body, a dispensing opening in said deck, a peripheral wall extending around said deck, and disk mounting means on said wall, and (b) mounting within said wall to said disk mounting means an actuator disk to pivot within said wall between a closed position closing said opening and an open position for dispensing product from said container through said opening and said disk.

2. The method set forth in claim 1 comprising the additional step, between said steps (a) and (b), of:

(c) filling said container with fluid product through said dispensing opening.

3. A method of making a fluid dispensing package, which includes the steps of:

(a) integrally molding a one-piece plastic container having a hollow flexible body with a closed bottom as molded, and a rigid finish including a deck extending across an upper end of said body, an open fill/dispensing opening in said deck and a wall around said deck, (b) filling said container with fluid product through said open fill/dispensing opening, and (c) mounting an actuator disk within said wall on said finish to pivot between a closed position closing said fill/dispensing opening and an open position for dispensing product from said container through said opening and said disk.

* * * * *